US005575258A

United States Patent [19]

Iochi

[11] Patent Number: 5,575,258

[45] Date of Patent: Nov. 19, 1996

[54] APPARATUS AND METHOD FOR DETERMINING ENGINE REVOLUTION DISPLACEMENT FOR MULTI-CYLINDER FOUR-STROKE INTERNAL COMBUSTION ENGINE

[75] Inventor: Atsushi Iochi, Yokohama, Japan

[73] Assignee: Nissan Motor Co., Ltd., Kanagawa, Japan

[21] Appl. No.: 438,128

[22] Filed: May 8, 1995

[30] Foreign Application Priority Data

May 9, 1994 [JP] Japan ..... 6-094714

[51] Int. Cl.[6] ..... F02D 45/00; F02P 7/06

[52] U.S. Cl. ..... 123/414; 123/479

[58] Field of Search ..... 123/414, 479, 123/630

[56] References Cited

U.S. PATENT DOCUMENTS

| | | | |
|---|---|---|---|
| 4,658,786 | 4/1987 | Foss et al. | 123/630 X |
| 4,660,535 | 4/1987 | Asano | 123/425 |
| 4,664,082 | 5/1987 | Suzuki | 123/414 |
| 4,690,123 | 9/1987 | Kimura et al. | 123/414 X |
| 4,941,445 | 7/1990 | Deutsch | 123/479 X |
| 4,960,092 | 10/1990 | Sasaki et al. | 123/414 |
| 5,101,796 | 4/1992 | Matsumura | 123/492 |

FOREIGN PATENT DOCUMENTS 59-208163 11/1984 Japan .

*Primary Examiner*—Tony M. Argenbright
*Attorney, Agent, or Firm*—Lowe, Price, Leblanc & Becker

[57] ABSTRACT

An apparatus and method for determining an engine operation control based engine revolution displacement for a multi-cylinder four-stroke internal combustion engine are disclosed in which a reference crank angle sensor is disposed on an engine crankshaft so as to output a reference signal which corresponds to a predetermined crank angular position with respect to a top dead center of each cylinder whenever the engine has revolved through a set crank angular displacement according to the number of cylinders (720°/6=120°, in the case of a six-cylinder engine). A unit crank angle sensor is disposed on the engine crankshaft so as to output a unit angle (1° or 2°) of the engine crankshaft revolution, a first counter (C1) is built in a gate array (IC-package or gate arrary IC) so as to count the unit angular signal (POS) upon receipt of the reference signal (REF) and so as to be reset to zero when a count value of the first counter has reached a predetermined count value corresponding to the set crank angular displacement and when the first counter receives the subsequent reference signal.

18 Claims, 5 Drawing Sheets

APPARATUS AND METHOD FOR DETERMINING ENGINE REVOLUTION DISPLACEMENT FOR MULTI-CYLINDER FOUR-STROKE INTERNAL COMBUSTION ENGINE

BACKGROUND OF THE INVENTION

1. Field of The Invention

The present invention relates to an apparatus and method for determining an engine revolution displacement for a multi-cylinder four-stroke internal combustion engine, an engine operation being controlled on the basis of the determined engine revolution displacement.

2. Description of The Background Art

Conventionally, a crank angle sensor of either photoelectrical pick-up or electromagnetic pick-up type is disposed on a member rotated in synchronization with engine revolutions in order to detect the engine revolution angular displacement used to control a fuel injection start timing of the engine or to control an ignition timing. The crank sensor has two functions: one of the functions outputting a reference signal (REF) which corresponds to a predetermined crankshaft angular displacement (position) (for example, 110° BTDC (Before Top Dead Center)) with respect to a top dead center in each one of the engine cylinders, the reference signal being output whenever the engine crankshaft has rotated through a predetermined crank angle set according to the number of cylinders (for example, in a case of the six-cylinder engine, 720°/6=120°) and the other function outputting a unit angular signal (POS) whenever the engine crankshaft has rotated through a unit angle of the crank angle (for example, 1° or 2°).

Hence, when a control unit connected with the crank angle sensor counts a number of the unit angular signal (POS) upon the start of the reference signal (REF), the control unit determines the engine revolution position nd uses the determined engine revolution position for the control of either the fuel injection start timing or the ignition timing for each spark plug installed for a corresponding one of the engine cylinders.

Since the engine revolution position is determined with the reference signal output from the crank angle sensor as the reference in the above-described engine revolution displacement determining apparatus, however, the determination of the engine revolution displacement becomes disabled if one or more of the reference signal is not received due to, for example, a disturbance. Consequently, during the engine operation control operation, either of the fuel injection or the ignition for one of the engine cylinders corresponding to a lost present reference signal cannot be carried out so that an engine revolution becomes out of order.

SUMMARY OF THE INVENTION

It is an object to provide an apparatus and method for determining an engine revolution displacement for a multi-cylinder four-stroke internal combustion engine which can assure the determination of the engine revolution displacement even if at least one of consecutive reference signals derived from a crank angle sensor is lost or missed due to an external disturbance and give no influence of the lost reference signal(s) on an engine operation control.

The above-described object can be achieved by providing an apparatus for determining an engine revolution displacement of a multi-cylinder, four-stroke internal combustion engine, an engine operation being controlled on the basis of the determined engine revolution displacement, said apparatus comprising: a) first detecting means for detecting a reference angular displacement of an engine revolution, the reference angular displacement corresponding to a predetermined crankshaft angular displacement with respect to a top dead center at which a piston of each cylinder has arrived, and for outputting a reference signal indicating the piston of each cylinder has arrived at the reference angular displacement whenever the engine crankshaft has rotated through the predetermined crankshaft angular displacement, the predetermined crankshaft angular displacement being set according to a number of the cylinders; b) second detecting means for detecting a unit angular displacement of the engine crankshaft and for outputting a unit angular signal whenever the engine crankshaft has rotated through the unit angular displacement; and c) pseudo signal generating means, having a first counter which is so constructed and arranged as to receive said reference signal and unit angular signal and as to count the unit angular signal upon receipt of said reference signal, said first counter being reset to zero and starting the counting of the unit angular signal whenever a count value of the first counter has reached a first predetermined value, said first predetermined value corresponding to the predetermined crankshaft angular displacement set between the outputs of the two consecutive reference signals and whenever the subsequent reference signal is received, said pseudo signal generating means generating a pseudo signal serving as a back-up signal for the reference signal whenever the count value of said first counter has reached the first predetermined value.

The above-described object can also be achieved by providing a method for determining an engine revolution displacement of a multi-cylinder, four-stroke internal combustion engine, an engine operation being controlled on the basis of the determined engine revolution displacement, said method comprising the steps of: a) detecting a reference angular displacement of an engine revolution, the reference angular displacement corresponding to a predetermined crankshaft angular displacement with respect to a top dead center at which a piston of each cylinder has arrived, and outputting a reference signal indicating the piston of each cylinder has arrived at the reference angular displacement whenever the engine crankshaft has rotated through the predetermined crankshaft angular displacement, the predetermined crankshaft angular displacement being set according to a number of the cylinders; b) simultaneously at the step a) detecting a unit angular displacement of the engine crankshaft and for outputting a unit angular signal whenever the engine crankshaft has rotated through the unit angular displacement; c) receiving said reference signal and unit angular signal by a first counter and counting the unit angular signal upon receipt of said reference signal, said first counter being reset to zero and starting the counting of the unit angular signal whenever a count value of the first counter has reached a first predetermined value, said first predetermined value corresponding to the predetermined crankshaft angular displacement set between the outputs of the two consecutive reference signals and whenever the subsequent reference signal is received; and d) generating a pseudo signal serving as a back-up signal for the reference signal whenever the count value of said first counter has reached the first predetermined value.

BEST MODE FOR CARRYING OUT THE INVENTION

Reference will hereinafter be made to the drawings in order to facilitate a better understanding of the present invention.

Figure 1:
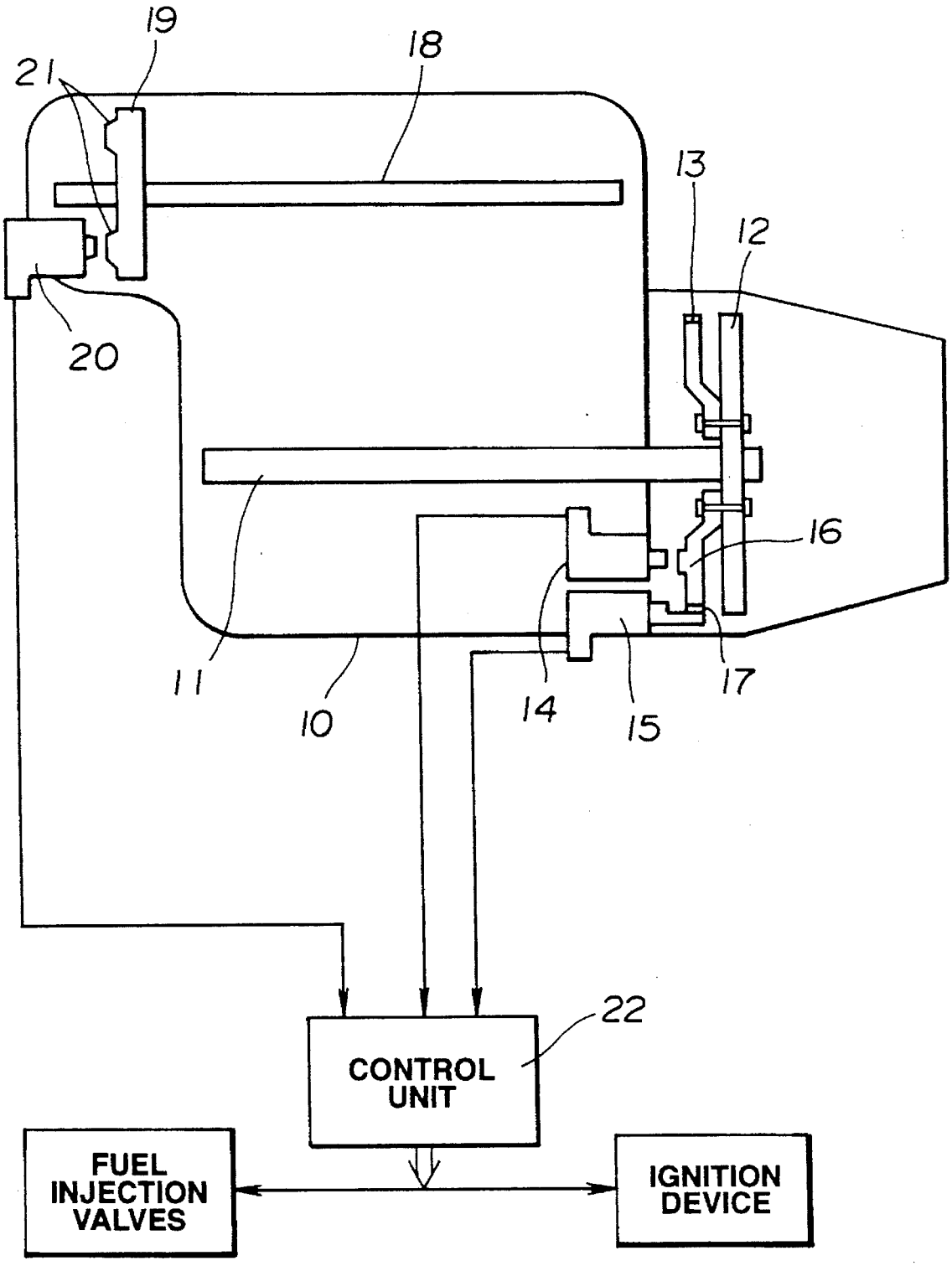
FIG. 1 is a schematic system configuration of an apparatus for determining an engine revolution displacement for a multi-cylinder four-stroke internal combustion engine in a preferred embodiment according to the present invention.

FIG. 1 shows a system configuration of an apparatus for determining an engine revolution displacement for a multi-cylinder four-stroke internal combustion engine in a preferred embodiment according to the present invention.

In the preferred embodiment, the internal combustion engine is a V-type six-cylinder engine.

As shown in FIG. 1, a timing plate 13 is attached onto a drive plate disposed on a engine crankshaft 11 of the engine 10. A reference crank angle sensor 14 is disposed on an inner peripheral end of the timing plate 13 and a unit crank angle sensor 15 is disposed on an outer peripheral end of the timing plate 15.

The reference crank angle sensor 14 and unit crank angle sensor 15 are constituted by electromagnetic pick-ups, respectively.

A plurality of projections 16 are extended on the inner peripheral end of the timing plate 13 so as to face toward the reference crank angle sensor 14, each one of the projections spaced apart from the adjacent projections by a distance corresponding to 120° in the case of the six-cylinder engine and being placed at a position corresponding to a predetermined crankshaft rotational angular position before a top dead center in a compression stroke of each cylinder (for example, BTDC 15°). Whenever each one of the projections is passed at the position faced toward the reference crank angle sensor 14, the reference signal (REF) is output from the reference crank angle sensor 14.

Figures 4A, 4B, 4C, 4D, 4E, 4F, 4G:
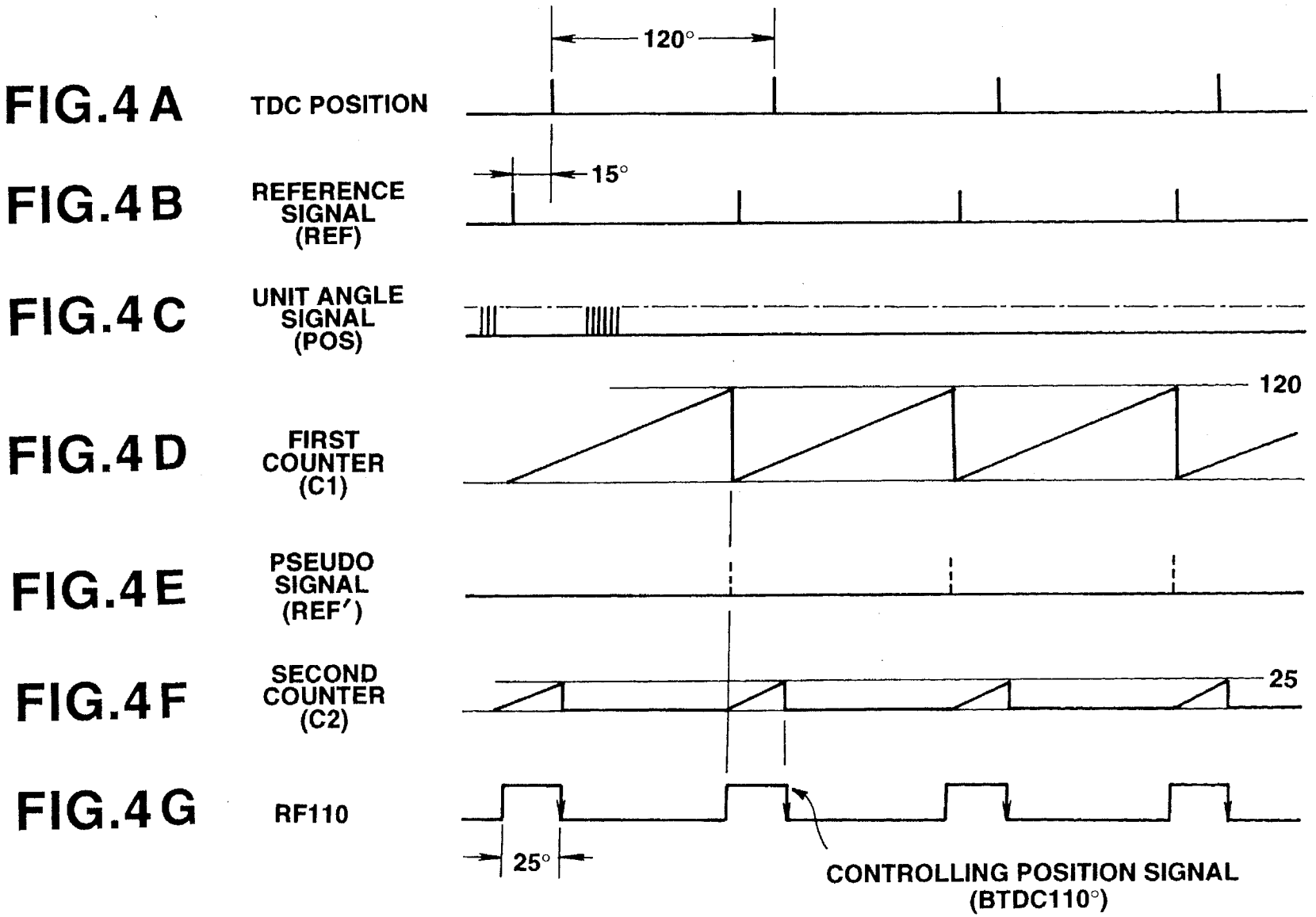
FIGS. 4A through 4G are signal timing charts for explaining an operation of the control unit shown in FIG. 2.
Figures 5A, 5B, 5C, 5D, 5E:
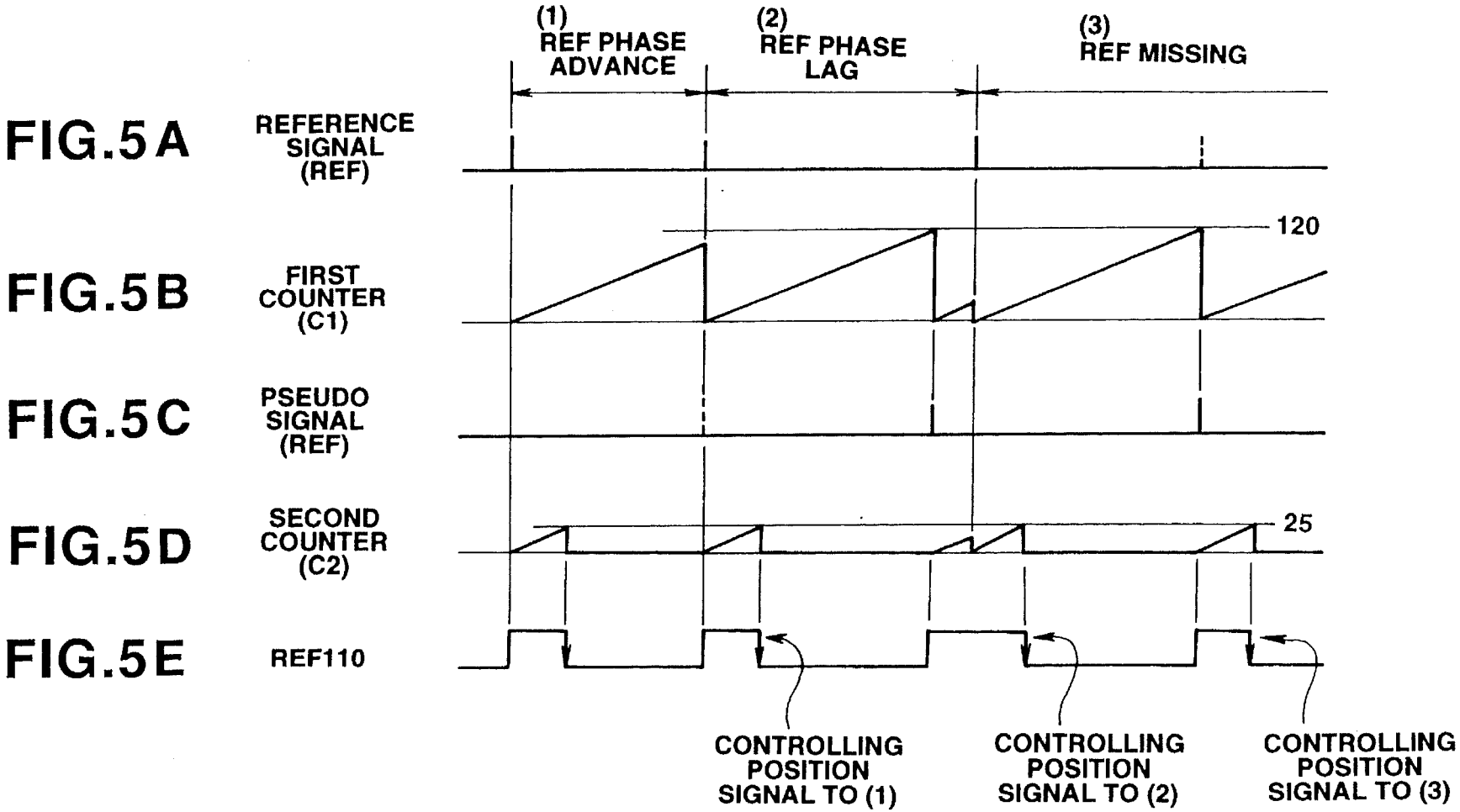
FIGS. 5A through 5E are signal timing charts for explaining the operation of the control unit shown in FIG. 2 in cases where three-types of signal troubles occur.

Hence, the reference crank angle sensor 14 outputs the reference signal (REF) corresponding to the predetermined crankshaft angular displacement (BTDC15°) with respect to a top dead center of each cylinder (in a compression stroke) for each crank angular displacement set according to the number of cylinders (in the case of the six-cylinder engine, 720°/6=120°)(refer to FIG. 4B).

On the other hand, for example, teeth are extended on the outer peripheral end of the timing plate 13 for each 1°. Hence, a unit angular signal (POS) is output from the unit crank angle sensor 15 for each of the unit angular displacement of 1°.

Another timing plate 19 is attached onto a cam shaft 18 which is rotated in synchronization with the engine crankshaft 11 at a speed half of the crankshaft. A cylinder number discriminating sensor 20 is disposed on a peripheral side of the timing plate 19.

The cylinder number discriminating sensor 20 includes an electromagnetic pick-up.

In detail, the peripheral side of the timing plate 19 is provided with a plurality of projections 21 having a number capable of identifying the cylinder numbers (#1 through #6) (for example, six kinds of the projections) between the reference signal and subsequent reference signal output from the reference crank angle sensor 14. When one of the projections is passed at a position faced toward the cylinder number discriminating sensor 20, the cylinder number discriminating sensor 20 outputs a cylinder number discriminating signal (PHASE) (a pulse train signal having the number of pulses different for respective cylinders between the reference signal and subsequent reference signal (REF)).

A control unit 22 is connected to the above-described reference crank angle sensor 14, unit crank angle sensor 15, and the cylinder number discriminating sensor 20. Thus, the control unit 22 receives the reference signal (REF), unit angular signal (POS), and the engine number discriminating signal (PHASE).

Figure 2:
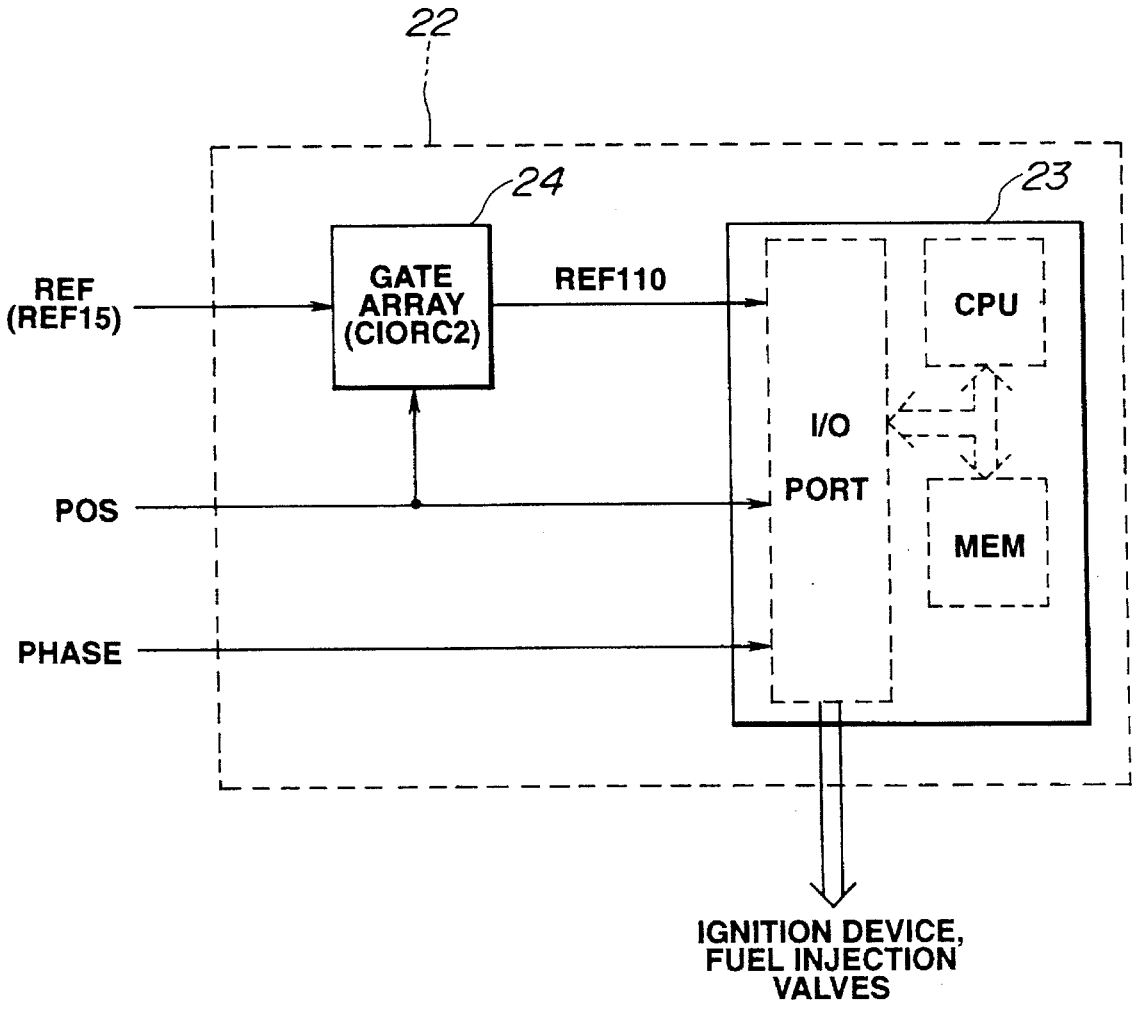
FIG. 2 is a circuit block diagram of a control unit shown in FIG. 1.

FIG. 2 shows a circuit block diagram of the control unit 22 shown in FIG. 1.

A microcomputer 23 is built in the control unit 22 and is operated to control an engine operation, such as a fuel injection start timing and duration control, and an ignition timing control.

It is noted that, as shown in FIG. 2, the reference signal (REF) derived from the reference crank angle sensor 15 is not directly input to the microcomputer 23 but is input to a gate array 24 (also referred to as IC package or gate array IC). The gate array 24 generates an engine controlling engine angular displacement signal REF110 in place of the reference signal from the input reference signal (REF) and unit angular signal (POS), the signal of REF110 being input to the microcomputer 23. It is also noted that a fist counter C1 and a second counter C2 (as will be described later) are built in the gate array 24.

The first counter C1 counts incrementally the number of the unit angular signal (POS) upon receipt of the reference signal (REF) and is reset at both timings when the count value of the first counter C1 has reached a predetermined value (120° in the case of the six-cylinder engine) set correspondingly to the set crankshaft rotational displacement (120°) between the outputs of the reference signal and the subsequently input reference signal (REF) and when the subsequent reference signal (REF) is received. The first counter C1 generates a pseudo signal REF' for backing up the reference signal when the count value has reached the predetermined value (120). In other words, the first counter C1 counts the number of the unit angular signal (POS) upon receipt of the reference signal (REF) (,i.e., whenever the reference signal is received) and generates the pseudo signal REF' for the back-up of the reference signal (refer to FIG. 4B) whenever the count value has reached the predetermined value (120) to be counted for the set crankshaft angular displacement (120°) between the reference signal and the subsequently input reference signal before the subsequent reference signal (REF) is to be input.

The second counter C2 counts the unit angular signal P0S upon receipt of either the reference signal REF or the pseudo signal REF' and generates the engine controlling engine revolution displacement signal (REF110) (refer to FIGS. 4F and 4G) when the count value of the second counter C2 has reached a predetermined count value (offset value of 25).

As described above, the second counter C2 counts the number of unit angular signal P0S upon receipt of the reference signal REF (or pseudo signal REF') generated at the BTDC15° of each cylinder so as to generate the engine controlling engine revolution displacement signal REF110 at BTDC110° offset 25° toward a retardation angle side from the reference signal position REF. The fuel injection and ignition timing controls are based on the engine controlling engine revolution displacement signal REF110 as the reference position. The fuel injection timing (and duration) control apparatus and method are exemplified by a U.S. Pat. No. 5,101,796 issued on Apr. 7, 1992. The ignition timing control apparatus and method are exemplified by a U.S. Pat. No. 4,660,535 issued on Apr. 28, 1987. Both disclosures of the United States Patents are herein incorporated by reference.

Figure 3:
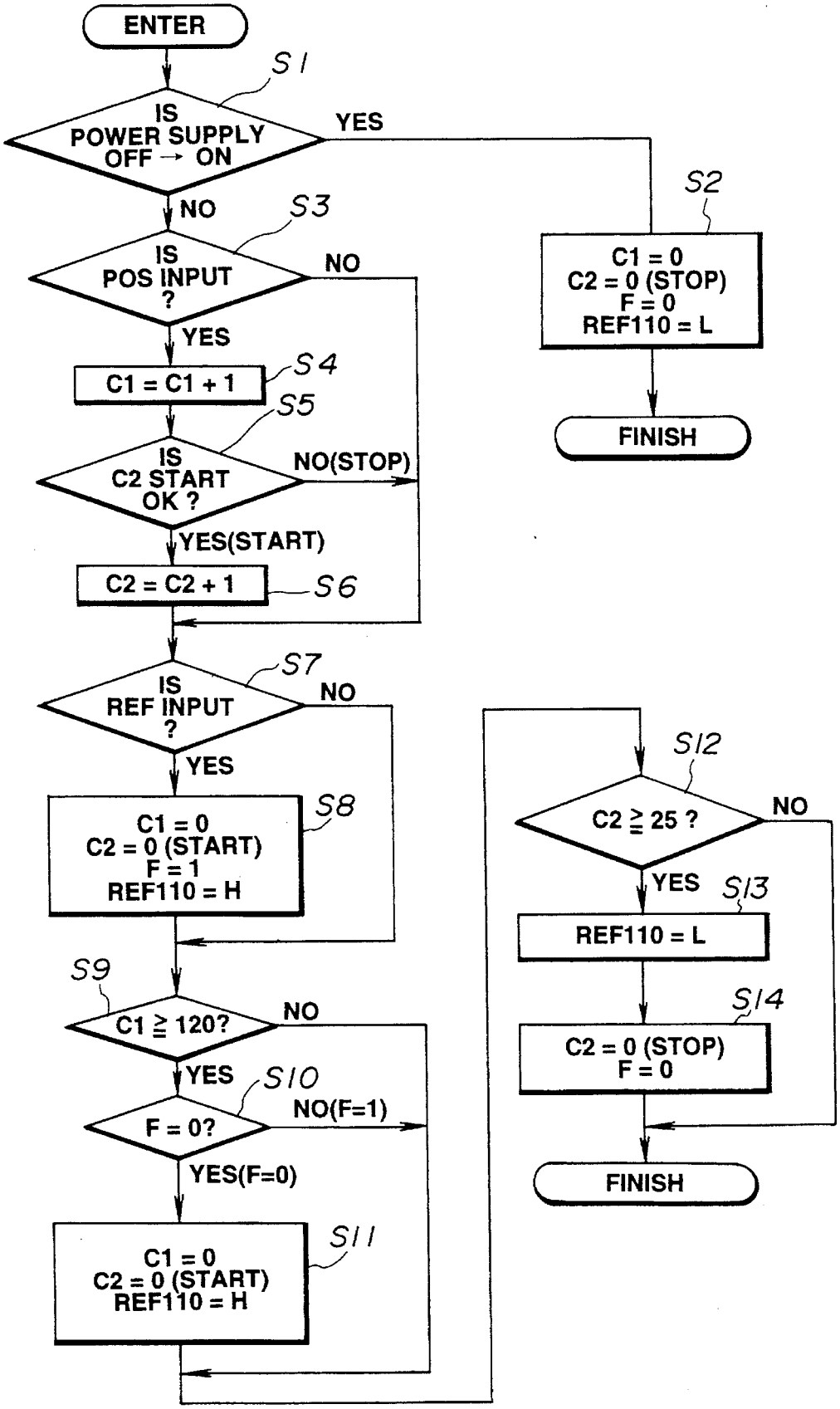
FIG. 3 is an operational flowchart in the control unit shown in FIG. 2 executed to generate an engine controlling angular position signal.

FIG. 3 shows an operational flowchart of generating the engine controlling engine revolution displacement signal (in detail, a falling edge from a logical H level to a logical L level of the signal REF110 ) according to the reference signal REF and unit angular signal POS using the first and second counters (120° counter) C1 and (25° counter) C2.

At a step S1, the control unit 22 determines whether a vehicular power supply is turned from an OFF state to an ON state, namely, whether it is the time immediately after the vehicular power supply is turned on. If Yes at the step S1, the routine goes to a step S2 for initialization only when the vehicle power supply is switched in the off state.

At the step S2, the first counter C1 is reset to zero, the second counter C2 is reset to zero, a REF input flag F being set to 0 and REF110 signal being set to a low level.

After the power supply is turned on, the routine goes to a step S3.

At the step S3, the control unit 22 determines whether the unit angular signal POS is input.

When the unit angular signal POS is received, the routine goes to a step S4 in which tile first counter C1 is started to count the unit angular signal (POS). Then, the routine goes to a step S5 in which the control unit 22 determines whether the second counter C2 is started. In a ease where the start of counting of the second counter C2 is permitted, the routine goes to a step S6 in which the second counter counts up the unit angular signal; (POS).

Thereafter, the routine goes to a step S7.

At the step S7, the control unit 22 determines whether the reference signal REF is input.

If Yes at the step S7, the routine goes to a step S8 in which the first counter C1 is reset to zero and the second counter C2 is reset to accept the receipt of the unit angular signal (POS), The REF input flag F being set to 1 and the REF signal REF110 being at a high (H) level.

Thereafter, the routine goes to a step S9.

At the step S9, the control unit 22 determines whether the count value of the first counter C1 has reached 120. When C1=120, the routine goes to a step S10 in which the control unit 22 determines whether a value of the REF input flag F is set to 1 or 0.

If the REF input flag F=0 (in a case where the subsequent reference signal REF is not input), the routine goes to a step S11 in which the first counter C1 is reset to zero, the second counter C2 is reset to zero to start, and the REF 11 signal is turned from the logical H level to the logical L level.

When the processing in the step S11 based on the determinations at the steps S9 and S10 in which the second counter C2 has reached the predetermined value (120) to be counted upon receipt of the reference signal (REF) before the input of the subsequent reference signal REF, the pseudo signal REF' is generated for the back-up of the reference signal. It is noted that the pseudo signal REF' is an internal signal but the external output of the pseudo signal REF' from the gate array 23 is not carried out.

Thereafter, the routine goes to a step S12.

At the step S12, the control unit 22 determines whether the count value of the second counter C2 has reached the predetermined value, i.e., 25.

When C2=25, the routine goes to a step S13 in which the signal REF110 is turned from the logical H level to the logical L level. Consequently, the signal REF110 rises from the high level (H) to the low level (L), this falling edge generating the engine controlling position signal at the BTDC110°.

In the processing at the step S13 based on the determination at the step S12, when the second counter C2 has reached the predetermined value (offset value; 25) upon receipt of either the reference signal REF or pseudo signal REF' (the series of processing at the steps S7 and S8 or processing at the steps 9 through 11), the engine controlling revolution signal (which is the falling edge from the high level (H) to the low (L) level of the REF110 signal) is generated.

In addition, if C2=25, the routine goes to a step S14 in which the second counter C2 is reset to zero and stopped and the REF input flag F is set to zero.

FIGS. 4A through 4F show timing charts for the reference signal REF, unit angular signal (POS), first counter (C1), pseudo signal (REF'), second counter (C2), and the engine controlling engine revolution displacement signal REF110 when the reference signal (REF) and the unit angular signal (POS) are normally received by the gate array 24.

The reference signal REF is output at BTDC15°.

The first counter (120° counter) is reset to zero so as to restart the counting of the unit angular signal POS and output the pseudo signal REF' when the count value of the first counter C1 has reached 120.

It is noted that if the unit angular signal (POS) is normally received, the time at which the subsequent reference signal (REF) is input and the time at which the count value of the first counter C1 are the same so that the pseudo signal REF' is not output.

Hence, when, at this time, the second counter (25° counter) C2 is reset upon the receipt of the reference signal REF and the counting of the unit angular signal POS is started by the second counter C2, the signal REF110 rises to the logical H level.

When the count value of the second counter C2 has reached 25, the signal REF110 falls to the L level, this falling edge serving as the engine controlling engine revolution displacement signal of BTDC110°.

In detail, the REF110 signal falls in the L level at BTDC110° which is offset by 25° from the reference signal REF, this falling edge of REF110 signal being used as the engine revolution reference signal on the basis of which the engine operation control is carried out.

Next, FIGS. 5A through 5F show signal timing charts of the reference signal (REF), count value of the first counter C1, the pseudo signal (REF'), the count value of the second counter (C2), and REF110 signal when various types of transmission errors occur.

(1) REF phase advance:

The REF phase advance is defined such a case that the subsequent reference signal REF is input before the count value of the first counter C1 has reached 120. Although the reference signal REF is normally transmitted from the reference crank angle sensor 14 and received at the first counter C1, an abnormality occurs due to a reason such as missed unit angular signal POS, for example, due to a noise superimposed on the unit angular signal POS so that a pulse train signal of P0S is deformed.

In this case, the first and second counters C1 and C2 are reset to zeros at a time at which the reference signal REF is received and the REF110 signal rises to the high (H) level. Thereafter, when the count value of the second counter C2 has reached 25, the REF110 signal falls into the low (L) level, this falling edge of the REF110 signal from the high (H) level to the low (L) level serving as the engine controlling engine revolution displacement signal.

Hence, in this case, the engine controlling engine revolution displacement signal which is offset by 25° from the displacement position of the reference signal REF is obtained.

(2) REF phase lag:

The REF phase lag is-defined such a case that after the count value of the first counter C1 has reached 120, the subsequent reference signal REF is input. Although the reference signal REF is normally transmitted from the reference crank angle sensor 14 and received at the first counter (gate array 23) C1, an abnormality has occurred due to a reason such that the noises are superimposed on the transmitted unit angular signal (POS) so that the pulse train signal of POS has increased number of pulses.

In this case, the pseudo signal REF' is generated at a time at which the count value of the first counter C1 has reached 120, this pseudo signal REF' resetting the first and second counters C1 and C2 to zero and the REF110 signal is caused to rise to the high (H) level. Thereafter, if the reference signal REF is input before the count value of the second counter C2 has reached 25, the first and second counters C1 and C2 are simultaneously reset to zeros. Thereafter, when the count value of the second counter C2 has reached 25, the REF110 signal is caused to fall into the low (L) level, this falling edge of the REF110 signal from the high level (H) to the low (L) level serving as the engine controlling engine revolution displacement signal.

Hence, in this case, as the final result, the engine controlling engine revolution displacement signal which is offset by 25° from the position of the reference signal is obtained.

(3) Missed REF:

The missed REF is defined such that the first counter C1 does not input the reference signal REF after the count value of the first counter C1 has reached 120. This is the case where the reference signal has missed (does not appear) and the abnormality occurs.

In this case, the pseudo signal REF' is generated when the count value of the first counter C1 has reached 120. This pseudo signal REF' causes both first and second counters C1 and C2 to be reset to zeros and the REF110 signal is caused to rise to the high (H) level. Thereafter, when the count value of the second counter C2 has reached 25, the REF110 signal is caused to fall to the low (L) level. This falling edge of the REF110 signal from the high (H) level to the low (L) level serves as the engine controlling engine revolution displacement signal.

Hence, in this case, the engine controlling engine revolution displacement signal is obtained which is offset by 25° from the position of the pseudo signal REF'.

Thus, even if the reference signal REF has missed, the determination of the engine controlling revolution displacement is possible and assured so that no influence of the missed reference signal on the engine controlling operation is given.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An apparatus for determining an engine revolution displacement of a multi-cylinder, four-stroke internal combustion engine, an engine operation being controlled on the basis of the determined engine revolution displacement, said apparatus comprising:

a) first detecting means for detecting a reference angular displacement of an engine revolution, the reference angular displacement corresponding to a predetermined crankshaft angular displacement with respect to a top dead center at which a piston of each cylinder has arrived, and for outputting a reference signal indicating the piston of each cylinder has arrived at the reference angular displacement whenever the engine crankshaft has rotated through the predetermined crankshaft angular displacement, the predetermined crankshaft angular displacement being set according to a number of the cylinders;

b) second detecting means for detecting a unit angular displacement of the engine crankshaft and for outputting a unit angular signal whenever the engine crankshaft has rotated through the unit angular displacement;

c) pseudo signal generating means, having a first counter which is so constructed and arranged as to receive said reference signal and unit angular signal and as to count the unit angular signal upon receipt of said reference signal, said first counter being reset to zero and starting the counting of the unit angular signal whenever a count value of the first counter has reached a first predetermined value, said first predetermined value corresponding to the predetermined crankshaft angular displacement set between the outputs of the two consecutive reference signals and whenever the subsequent reference signal is received, said pseudo signal generating means generating a pseudo signal serving as a back-up signal for the reference signal whenever the count value of said first counter has reached the first predetermined value; and d) engine controlling displacement signal generating means for generating an engine controlling displacement signal on the basis of either of said reference signal or the pseudo signal.

2. An apparatus for determining an engine revolution displacement of a multi-cylinder, four-stroke internal combustion engine, an engine operation being controlled on the basis of the determined engine revolution displacement as claimed in claim 1, wherein said engine controlling displacement signal generated by said engine controlling displacement signal generating means corresponds to a crankshaft angular position offset toward a predetermined retardation angular displacement from the predetermined crankshaft angular displacement at which said first detecting means would normally output the reference signal.

3. An apparatus for determining an engine revolution displacement of a multi-cylinder, four-stroke internal combustion engine, an engine operation being controlled on the basis of the determined engine revolution displacement as claimed in claim 2, wherein said engine controlling displacement signal generating means comprises a second counter which is so constructed and arranged as to count the unit angular signal whenever either of said reference signal or pseudo signal is received and as to output the engine controlling displacement signal whenever a count value of the second counter has reached a second predetermined value.

4. An apparatus for determining an engine revolution displacement of a multi-cylinder, four-stroke internal combustion engine, an engine operation being controlled on the basis of the determined engine revolution displacement as claimed in claim 3, wherein said second counter starts the counting of the unit angular signal upon receipt of either of said reference or pseudo signal one of which is earlier than the other.

5. An apparatus for determining an engine revolution displacement of a multi-cylinder, four-stroke internal combustion engine, an engine operation being controlled on the basis of the determined engine revolution displacement as claimed in claim 4, wherein said second counter resets the count value thereof and restarts the counting of the unit angular signal after starting the counting of the unit angular signal upon receipt of the pseudo signal and when receiving the reference signal before the count value of the second counter has reached the second predetermined value.

6. An apparatus for determining an engine revolution displacement of a multi-cylinder, four-stroke internal combustion engine, an engine operation being controlled on the basis of the determined engine revolution displacement as claimed in claim 5, wherein the second predetermined count value of the second counter corresponds to the predetermined retardation angle value.

7. An apparatus for determining an engine revolution displacement of a multi-cylinder, four-stroke internal combustion engine, an engine operation being controlled on the basis of the determined engine revolution displacement as claimed in claim 6, which further comprises engine cylinder number discriminating means for discriminating a cylinder number of each engine cylinder and outputting a PHASE signal indicating the cylinder number whenever the reference signal is output from said fist detecting means.

8. An apparatus for determining an engine revolution displacement of a multi-cylinder, four-stroke internal combustion engine, an engine operation being controlled on the basis of the determined engine revolution displacement as claimed in claim 7, wherein said engine controlling displacement signal generating means comprises a signal falling edge generator which is so constructed and arranged as to generate a pulse signal having a rising edge whenever the second counter starts the counting of the unit angular signal and a falling edge whenever the count value of said second counter has reached the second predetermined value, the falling edge serving as the engine controlling displacement signal.

9. An apparatus for determining an engine revolution displacement of a multi-cylinder, four-stroke internal combustion engine, an engine operation being controlled on the basis of the determined engine revolution displacement as claimed in claim 8, wherein said first counter and second counter constitute a gate array and wherein said first and second detecting means comprise a reference crank angle sensor and a unit crank angle sensor, each disposed on the engine crankshaft.

10. An apparatus for determining an engine revolution displacement of a multi-cylinder, four-stroke internal combustion engine, an engine operation being controlled on the basis of the determined engine revolution displacement as claimed in claim 9, said crank angle sensor installed on a drive plate disposed on the engine crankshaft, the timing plate having a plurality of projections arranged on its inner periphery, one of the projections being spaced apart from the adjacent one of the projections by the predetermined crankshaft angular displacement and having teeth arranged on its periphery, one of the teeth being spaced apart from the adjacent one of the teeth by the unit angular displacement; and first and second electromagnetic pick-ups, each pick-up being faced toward the plurality of projections of the timing plate and toward the teeth of the timing plate.

11. An apparatus -for determining an engine revolution displacement of a multi-cylinder, four-stroke internal combustion engine, an engine operation being controlled on the basis of the determined engine revolution displacement as claimed in claim 10, wherein said gate array receives the reference signal (REF) derived from said reference crank angle sensor and the unit angular signal (POS) from the unit crank sensor and outputs the engine controlling displacement signal (REF) to a microcomputer, the microcomputer receiving the engine controlling displacement signal (REF110), the unit angular signal (POS), and the PHASE signal.

12. An apparatus for determining an engine revolution displacement of a multi-cylinder, four-stroke internal combustion engine, an engine operation being controlled on the basis of the determined engine revolution displacement as claimed in claim 2, which further comprises engine ignition timing controlling means for controlling an engine ignition timing for each spark plug installed for a corresponding one of the engine cylinders on the basis of the engine controlling signal generated by the engine controlling displacement signal generating means.

13. An apparatus for determining an engine revolution displacement of a multi-cylinder, four-stroke internal combustion engine, an engine operation being controlled on the basis of the determined engine revolution displacement as claimed in claim 2, which further comprises fuel injection timing controlling means for controlling a fuel injection start timing for each fuel injection valve installed for a corresponding one of the engine cylinders on the basis of the engine controlling displacement signal.

14. An apparatus for determining an engine revolution displacement of a multi-cylinder, four-stroke internal combustion engine, an engine operation being controlled on the basis of the determined engine revolution displacement as claimed in claim 6, wherein the number of the engine cylinders are six and wherein the unit angular signal has a time period corresponding to 1° of the engine crankshaft rotation angle.

15. An apparatus for determining an engine revolution displacement of a multi-cylinder, four-stroke internal combustion engine, an engine operation being controlled on the basis of the determined engine revolution displacement as claimed in claim 14, wherein the predetermined angular displacement is 15° BTDC and the predetermined count value of the first counter is 120°.

16. An apparatus for determining an engine revolution displacement of a multi-cylinder, four-stroke internal combustion engine, an engine operation being controlled on the basis of the determined engine revolution displacement as claimed in claim 15, wherein the predetermined retardation angle offset from the piston top dead center is 25°.

17. A method for determining an engine revolution displacement of a multi-cylinder, four-stroke internal combustion engine, an engine operation being controlled on the basis of the determined engine revolution displacement, said method comprising the steps of:

a) detecting a reference angular displacement of an engine revolution, the reference angular displacement corresponding to a predetermined crankshaft angular displacement with respect to a top dead center at which a piston of each cylinder has arrived, and outputting a reference signal indicating the piston of each cylinder has arrived at the reference angular displacement whenever the engine crankshaft has rotated through the predetermined crankshaft angular displacement, the predetermined crankshaft angular displacement being set according to a number of the cylinders;

b) simultaneously at the step a) detecting a unit angular displacement of the engine crankshaft and for outputting a unit angular signal whenever the engine crankshaft has rotated through the unit angular displacement;

c) receiving said reference signal and unit angular signal by a first counter and counting the unit angular signal upon receipt of said reference signal, said first counter being reset to zero and starting the counting of the unit angular signal whenever a count value of the first counter has reached a first predetermined value, said first predetermined value corresponding to the predetermined crankshaft angular displacement set between the outputs of the two consecutive reference signals and whenever the subsequent reference signal is received;

d) generating a pseudo signal serving as a back-up signal for the reference signal whenever the count value of said first counter has reached the first predetermined value; and e) generating an engine controlling displacement signal on the basis of either of said reference signal or the pseudo signal and wherein, at said step e), said engine controlling displacement signal corresponds to a crankshaft angular position offset toward a predetermined retardation angular displacement from the predetermined crankshaft angular displacement at which at said step a) the reference signal would normally be outputted.

18. A method for determining an engine revolution displacement of a multi-cylinder, four-stroke internal combustion engine, an engine operation being controlled on the basis of the determined engine revolution displacement as claimed in claim 17, wherein the method further comprises the step of f) outputting an ignition signal to each one of spark plugs at a timing determined on the basis of the engine controlling displacement signal.

* * * * *